US007419940B2

(12) United States Patent
Yoon et al.

(10) Patent No.: US 7,419,940 B2
(45) Date of Patent: Sep. 2, 2008

(54) BORATED-EPOXIDIZED POLYBUTENES AS LOW-ASH ANTI-WEAR ADDITIVES FOR LUBRICANTS

(75) Inventors: Beth A. Yoon, Pennington, NJ (US); Liehpao Oscar Farng, Lawrenceville, NJ (US); George Skic, Lambertville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 728 days.

(21) Appl. No.: 10/951,356

(22) Filed: Sep. 28, 2004

(65) Prior Publication Data

US 2005/0137096 A1 Jun. 23, 2005

Related U.S. Application Data

(60) Provisional application No. 60/531,560, filed on Dec. 19, 2003.

(51) Int. Cl.
*C10M 163/00* (2006.01)

(52) U.S. Cl. ..... 508/185

(58) Field of Classification Search ..... 508/185
See application file for complete search history.

(56) References Cited

U.S. PATENT DOCUMENTS

| | | | | |
|---|---|---|---|---|
| 4,410,438 | A | 10/1983 | Horodysky | 252/49.6 |
| 4,522,734 | A | 6/1985 | Horodysky et al. | |
| 4,563,293 | A | 1/1986 | Small, Jr. | |
| 4,584,115 | A | 4/1986 | Davis et al. | |
| 4,692,257 | A | 9/1987 | Horodysky | |
| 5,585,444 | A | 12/1996 | Blackborow et al. | |
| 5,595,964 | A | 1/1997 | Bardasz | |
| 5,759,965 | A | 6/1998 | Sumiejski | 508/186 |

FOREIGN PATENT DOCUMENTS

| | | | |
|---|---|---|---|
| DE | 285 983 | A5 | 10/1983 |
| EP | 0 067 002 | | 5/1982 |
| EP | 0 204 039 | | 6/1985 |
| EP | 0673991 | A1 | 9/1995 |
| WO | WO 03/070863 | A2 | 8/2003 |

*Primary Examiner*—Walter D. Griffin
*Assistant Examiner*—Frank C Campanell
(74) *Attorney, Agent, or Firm*—Estelle C. Bakun

(57) ABSTRACT

An engine lubricant that is substantially free of zinc and phosphorous contains an antiwear additive comprising borated 1,2 epoxy mixed polybutenes having an average carbon number in the range of $C_{20}$ to about $C_{120}$.

6 Claims, No Drawings

BORATED-EPOXIDIZED POLYBUTENES AS LOW-ASH ANTI-WEAR ADDITIVES FOR LUBRICANTS

This application claims the benefit of U.S. Ser. No. 60/531,560 filed Dec. 19, 2003.

FIELD OF INVENTION

The present invention relates generally to lubricating compositions for internal combustion engines, which compositions are substantially free of phosphorus and zinc. More particularly the present invention relates to boron-containing, anti-wear additives for lubricating compositions.

BACKGROUND OF THE INVENTION

Contemporary engine oils are formulations that include a base oil of lubricating viscosity and a variety of additives, or additive packages. The additives or additive packages are included in the formulation with the objective of improving the performance of the base oil in any number of important respects. For example, additives may be used for such purposes as reducing engine wear, improving detergency, inhibiting corrosion, stabilizing the oil against heat and oxidation and the like.

Contemporary engine oil technology uses zinc dialkyldithio-phosphates (ZDDP) for corrosion, oxidation and wear protection and metallic detergents for engine cleanliness. These additives are rich in sulfur, phosphorous and ash content and play a critical role in meeting severe engine performance requirements. Unfortunately, phosphorous tends to deactivate the catalysts typically employed for control of hydrocarbon emissions from the engine. Volatile sulfur is harmful to catalysts used to control NOx emissions; and zinc contributes to plugging engine exhaust particulate filters. Although sulfur emissions can be reduced by formulating lubricant compositions using low sulfur base oils as much as two thirds of the sulfur and almost all of the phosphorus present in engine oils is due to the use of ZDDP. Thus, there is a need for low sulfur engine oils that are substantially free of zinc and phosphorus and yet which do not adversely effect engine performance. Indeed there is a need for low ash, low sulfur engine oils that are substantially free of phosphorus and zinc. The present invention has among its objectives meeting these and other needs.

SUMMARY OF INVENTION

In one aspect, the present invention is directed to a lubricating composition substantially free of zinc and phosphorous, the composition comprising:

(a) a major amount of a base oil;

(b) a minor amount of borated 1,2 epoxy mixed polybutenes having an average carbon number in the range of $C_{20}$ to about $C_{120}$; and (c) with the proviso that the composition contains less than 300 ppm boron.

Another aspect of the invention is directed to a lubricating composition that is substantially metal and phosphorus free, which composition comprises:

(a) a major amount of a base oil;

(b) a minor amount of an anti-wear additive comprising borated mixed 1,2 epoxy polybutenes having an average carbon number in the range of $C_{20}$ to about $C_{120}$; and (c) with the proviso that the composition contains less than 300 ppm boron.

These and other aspects of the invention will become apparent from the detailed description which follows.

DETAILED DESCRIPTION OF INVENTION

The lubricating compositions of the present invention comprise a major amount of a base oil of lubricating viscosity, are substantially zinc and phosphorous free and contain not more than 300 ppm of boron in the form of a specific borated anti-wear additive.

The base oils of the present invention include natural and synthetic oils of lubricating viscosity and mixtures thereof. Natural oils include paraffinic, naphthenic, aromatic, and mixed paraffinic-naphthenic-aromatic oils. Synthetic oils include poly alpha olefins, polyinternal olefins, polyalkylene glycols, alkylated aromatics, cycloaliphatics, polybutenes, dialkyl carbonates, polyesters, Fischer-Tropsch derived oils (gas-to-liquids lubricants) and the like. Thus, the base oil may comprise Group I, Group II, Group III, Group IV or Group V basestocks or blends of these basestocks. These basestocks are defined in the American Petroleum Institute publication "Engine Oil Licensing and Certification System", Industry Services Department, 14th Edition, December 1966, Addendum 1, Dec. 1998.

The lubricating compositions of the invention include a minor amount of an anti-wear additive comprising borated 1,2 epoxy mixed polybutenes having an average carbon member in the range of $C_{20}$ to about $C_{120}$, and preferably $C_{20}$ to $C_{80}$. These terminally epoxidized polybutenes may be represented by formula I below:

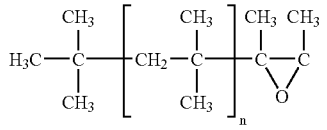

(I)

where n represents the number of repeating butene moiety units.

The 1,2 epoxy mixed polybutenes are borated in the presence of a hydrocarbon solvent that is chemically inert to the reactants and azeotropic to water such as toluene, benzene, xylenes, nonane, and the like. The preferred boron compound is boric acid although boric oxide and alkyl borates may be used.

Optionally, the epoxides may be borated in the presence of an alcohol. Suitable alcohols include alkyl alcohols having from 1 to about 30 carbon atoms and preferably from 3 to 20 carbon atoms.

The molar ratio of boron compound to 1,2-epoxide mixed polybutenes, and even the optional alcohol can vary widely. Indeed an excess of any one of the reagents may be employed or equimolar quantities of the two or optionally three reagents may be used. The amount of boron in the resulting product, however, should be in the range of about 0.1 wt % to about 10 wt % and preferably from about 0.5 wt % to about 5 wt %.

The reaction can be carried out at temperatures in the range of about 90° C. to about 260° C. and preferably from about 110° C. to about 200° C.

Also the reaction preferably is conducted at atmospheric pressure but when warranted elevated pressures may be employed.

The reaction time is not critical. Typically the reaction will be carried out over a period of from about 30 minutes to about 8 hours and more typically about 45 minutes to about 3.0 hours.

The amount of the borated epoxy anti-wear additive used in the lubricating compositions of the invention is a minor amount; however, the total amount of boron in the lubricating composition should be less than 300 ppm, preferably in the range of about 20 ppm to about 250 ppm boron and more preferably in the range of about 20 ppm to about 65 ppm.

As indicated, the lubricant composition of the invention are substantially free of zinc and phosphorous. In one embodiment of the invention the compositions are substantially metal and phosphorous free. Thus compositions of the present invention are devoid of ZDDP and may also be devoid of molybdenum anti-wear additives, metal detergents and the like.

The composition of the invention may include ashless additives typically employed in lubricant formulations such as ashless dispersants, antioxidants, detergents, pour point depressants, viscosity index improvers, and the like.

Suitable ashless dispersants include sulfur and phosphorous free succinimides, carboxylic acid amides, hydrocarbyl polyamines, hydrocarbyl succinate esters, and nitrogen containing methacrylate polymers. Preferably, the ashless dispersant in the composition will be in the range of about 0.5 to about 10 wt % based on the total weight of the composition.

Compositions of the invention also may include such ashless antioxidants as aminic and phenolic antioxidants. Suitable aminic antioxidants include alkylated diphenyl amines, alkylated phenylenediamines, and the like. Suitable phenols include alkyl hindered phenols such as 2,6-di-t-butyl phenol, 4,4'-methylene-bis-(2,6-di-t-butyl phenol) and 2,6-di-t-butyl-alpha-diethylamino-p-cresol. Such antioxidants may constitute from about 0.5 wt % to about 5 wt % based on the total weight of the lubricant composition.

Among suitable viscosity index improvers mention is made of methacrylate polymers, butylene polymers, polymerized olefins and alkylated styrene polymers. These may be used in amounts ranging from about 0.5 wt % to about 10 wt % based on the total weight of the components.

Suitable pour point dispersants include methacrylate polymers and alkylated napthalene. There may be used in effect amounts ranging from about 0.1 wt % to about 2 wt % based on the total weight of the composition.

EXAMPLES

The invention will be further illustrated by the following examples.

Example 1

Approximately 50 g mixed C24 1,2-epoxy polybutene, 5.5 boric acid and 150 ml toluene were charged to a four-necked flask equipped with Dean stark trap, condenser, thermometer, stirrer and nitrogen inlet. The contents were heated slowly to 90° C. and were held there for about 1 hour. The temperature was raised to about 111° C. and held there until there was no more water evolution. The mixture was hot-filtered and the solvent removed by evaporation, yielding a clear yellow fluid product. Boron was measured (ASTM D4172) to be 0.42%.

Example 2

Approximately 50 g of a mixed C24 1,2-epoxy polybutene, 5.5 g boric acid, 30 ml n-butanol, and 60 ml toluene were charged to a four-necked flask equipped with Dean stark trap, condenser, thermometer, stirrer and nitrogen inlet. The contents were heated to 90° C. and held there for 2 hours. The mixture was then heated up to 110° C. for about 3 hours until no more water evolution was observed. The solvents were stripped and the product hot-filtered to yield a clear yellow fluid. Boron was measured (ASTM D4172) to be 0.51%.

Example 3

Approximately 52.6 g of a mixed C64 1,2-epoxy polybutene, 2.2 g boric acid, 12 ml n-butanol, and 60 ml toluene were charged to a four-necked flask equipped with Dean stark trap, condenser, thermometer, stirrer and nitrogen inlet. The contents were heated to 90° C. and held there for 1 hour. The mixture was then heated up to 110° C. for about 10 hours until no more water evolution was observed. The solvents were striped to yield a clear yellow fluid. Boron was measured (ASTM D4172) to be 0.20%.

Evaluation of Products

The compounds of Examples 1 to 3 were evaluated for anti-wear performance using the Four-Ball test (ASTM D-4172-1) by blending the compounds in a fully formulated % phosphorous, commercial engine oil at a level to provide wt % of the additive in the oil. For comparative purposes the results were compared to the base oil above and in two instances, of the base oil with different levels of ZDDP (Reference 1 and Reference 2 respectively).

Compositional characteristics of the oil and the blends are given in Table 1 and the results of the anti-wear test is given in Table 2.

In Table 2, the K factor is a dimensionless number related to the wear volume. Smaller numbers are highly desirable.

TABLE 1

| | % P | B (ppm) | Epoxy Polybutene C (Ave) |
|---|---|---|---|
| Base Oil | 0 | 0 | N/A |
| Reference 1 | 0.12 | 0 | N/A |
| Reference 2 | 0.06 | 0 | N/A |
| Example 1 | 0 | 42 | 24 |
| Example 2 | 0 | 51 | 24 |
| Example 3 | 0 | 20 | 64 |

N/A = not applicable

TABLE 2

| | 4 Ball Wear (D4172) 40 Kg/1800 rpm/30 minutes/200° F. | | |
|---|---|---|---|
| | % P | WSD (mm) | K Factor ($\times 10^{-8}$) |
| Base Oil | 0 | 1.767 | 530.5 |
| Reference 1 | 0.12 | 0.544 | 4.02 |
| Reference 2 | 0.06 | 0.633 | 7.88 |
| Example 1 | 0 | 0.433 | 1.30 |
| Example 2 | 0 | 0.439 | 1.39 |
| Example 3 | 0 | 0.606 | 6.48 |

The blends were also tested for friction modification properties (Table 3), anti-oxidancy (pressurized DSC, Table 4) and anti-corrosion (copper strip D130, Table 5) properties. Examples 1-3 improve friction reducing properties with respect to the formulated base oil. The frictional properties were measured via a High Frequency Reciprocating Righ (HFRR). The average friction values of each additive lie between Reference 1 and Reference 2 (Table 3, 0.12 and 0.06% P, respectively). Examples 1-3 also helped maintain good protective films, which are critical to engine lubricant performance (Table 3). No change in copper corrosion is observed for Examples 1-3 with respect to the base oil.

TABLE 3

| | HFRR | | |
|---|---|---|---|
| | % P | Average Friction | % Average Film |
| Base Oil | 0 | 0.12 | 95.6 |
| Reference 1 | 0.12 | 0.11 | 95.4 |
| Reference 2 | 0.06 | 0.12 | 94.8 |
| Example 1 | 0 | 0.11 | 93.3 |
| Example 2 | 0 | 0.11 | 96.1 |
| Example 3 | 0 | 0.11 | 98.1 |

TABLE 4

| | PDSC (Ramp 10° C./minute) | |
|---|---|---|
| | % P | Onset Temperature (° C.) |
| Base Oil | 0 | 250.1 |
| Reference 1 | 0.12 | 241.2 |
| Reference 2 | 0.06 | 250.6 |
| Example 1 | 0 | 252.6 |
| Example 2 | 0 | 253.1 |
| Example 3 | 0 | 252.2 |

TABLE 5

| | Copper Corrosion (D130-6) | |
|---|---|---|
| | % P | @ 3 hours/250° F. |
| Base Oil | 0 | 2A |
| Reference 1 | 0.12 | 1A |
| Reference 2 | 0.06 | 1A |
| Example 1 | 0 | 2A |

TABLE 5-continued

| | Copper Corrosion (D130-6) | |
|---|---|---|
| | % P | @ 3 hours/250° F. |
| Example 2 | 0 | 2A |
| Example 3 | 0 | 2A |

What is claimed is:

1. A method for improving the wear properties of a substantially zinc and phosphorus free lubricating oil, the method comprising adding to the oil borated 1,2 epoxy mixed polybutenes having an average carbon number in the range of $C_{20}$ to about $C_{120}$ in an amount to provide the oil with less than 300 ppm boron, the wear properties of the lubricating oil being improved in comparison to the wear proverties exhibited by substantially zinc and phosphorus free lubricating oil which does not contain the borated 1,2 epoxy mixed polybutenes.

2. The method of claim 1 wherein the borated 1,2 epoxy polybutenes contain about 0.1 wt % to about 10 wt % boron.

3. The method of claim 2 wherein the borated polybutenes are added in an amount to provide the oil with about 20 ppm to about 250 ppm boron.

4. A method for reducing wear in an engine by lubricating the engine using a lubricating oil substantially free of zinc and phosphorus comprising a major amount of a base oil and a minor amount of borate 1,2 epoxy mixed polybutenes having an average carbon number in the range of C20 to about C120 wherein the lubricating oil contains less than 300 ppm boron, the wear being reduced to a higher degree than when the substantially zinc and phosphorus free oil does not contain the borated 1,2 epoxy mixed polybutenes.

5. The method of claim 4 wherein the borated 1,2 epoxy mixed polybutenes contains about 0.1 wt % to about 10 wt % boron.

6. The method of claim 5 wherein the borated 1,2 epoxy mixed polybutenes are added in an amount to provide the oil with about 20 ppm to about 250 ppm boron.

* * * * *